United States Patent [19]

Sias et al.

[11] 4,307,828

[45] Dec. 29, 1981

[54] DISPENSING CARTON

[75] Inventors: Dennis M. Sias, Midland; Richard G. Paxton, Coleman, both of Mich.

[73] Assignee: The Dow Chemical Company, Midland, Mich.

[21] Appl. No.: 160,797

[22] Filed: Jun. 19, 1980

[51] Int. Cl.[3] ..... B26D 1/01

[52] U.S. Cl. ..... 225/25; 225/43; 225/48

[58] Field of Search ..... 225/25, 43, 48; 206/395, 396, 408

[56] References Cited

U.S. PATENT DOCUMENTS

| | | | |
|---|---|---|---|
| 3,028,060 | 4/1962 | Haley | 225/25 X |
| 3,114,488 | 12/1963 | Mounts | 225/48X |
| 3,549,066 | 12/1970 | Wankow | 225/25 |
| 3,845,894 | 11/1974 | Merlin | 225/25 |
| 3,974,947 | 8/1976 | Budny | 225/25 |

*Primary Examiner*—Frank T. Yost

*Attorney, Agent, or Firm*—D. R. Howard

[57] ABSTRACT

An improved dispensing carton for dispensing materials, such as polymeric films, which are commonly supplied in roll form. The carton type is known to those skilled in the art as a "trunk lid" style carton. The improvements to the carton are: (1) placing a cutting bar on the inside of and along the front of the carton lid in such a manner that a cutting edge projects beyond the lower edge of the front of the carton lid; (2) positioning an adhesive material retaining device on the outer face of the front panel of the carton near the upper edge of the front panel in such a manner that when the carton is closed the material retaining device is covered by the carton lid; (3) positioning on the inner face of the front of the carton lid an adhesive surface protecting device, the adhesive surface protecting device being positioned so that when the carton lid is in a closed configuration, the adhesive surface protecting device covers the material retaining device; and (4) providing a carton opening assisting device which is an integral part of the front of the carton lid, the carton opening assisting device being generally centrally located along a lower edge of the front of the carton lid. This configuration prevents the leading edge of the material on the roll from withdrawing back into the carton, and prevents the leading edge from being wrinkled or torn.

6 Claims, 3 Drawing Figures

DISPENSING CARTON

BACKGROUND OF THE INVENTION

This invention relates to an improved dispensing container or carton for materials supplied in roll form, particularly polymeric film, wax paper, metal foil and like wrapping materials for household and other uses. It has been known heretofore to provide dispensing cartons which are foldably erected from flat carton blanks of paper or paperboard materials. One of the recognized problems for cartons of this type is that a lead portion of the roll, after it is started is usually not adequately prevented from withdrawing back into the carton. This problem is most objectionable regarding wrapping materials of the general type having cling characteristics, since the lead portion or "lost" end tends to adhere to the roll, and become indistinguishable, or nearly so, against the background of the roll. Such occurs with some frequency as it has been, and is, a foremost source of consumer complaints.

"Cling" as used herein is that property of a polymeric film either imparted thereto by suitable additives or occurring naturally therein which enables the film to stick or "cling" to itself or to other smooth surfaces. A practical solution to this problem has proved difficult in view of the need for strict compliance and compatibility with factors relating to the manufacture and loading of the carton, as well as factors which may be associated with marketing and consumer use aspects.

For example, roll dispensing cartons are manufactured, erected, and loaded at extremely high speeds. Any modification to the carton which would impede its rate of manufacture, or the rate of loading or erecting thereof, would be of doubtful value, since it would materially add to the cost of erecting and loading the carton. Some have attempted to solve this problem, as typically shown by a Wankow U.S. Pat. No. 3,549,066. Wankow provides a series of vinyl spots, said vinyl spots being made from a vinyl resinous composition, on the container front wall adjacent to cutter bar to retain and hold the remaining lead portion of "cling" type polymeric film to the container after a desired length has been torn off. While somewhat successful in holding such "cling" type films, the vinyl spots are incapable of holding other films not possessing "cling" characteristics. Wankow also discloses using various other types of spot material for retaining "cling" type films. In addition, Wankow discloses the use of pressure sensitive adhesive spots for holding non-"cling" type films. Wankow does not, however, disclose how to keep such pressure sensitive spots from being removed upon opening the carton nor does he disclose how to protect such pressure sensitive spots from being contaminated by dust or other foreign matter after the carton is opened and portions of the lead portion of the roll material are not being held by such pressure sensitive spots.

Budny, U.S. Pat. No. 3,974,947, has attempted to resolve the aforementioned problems by providing a double ply front panel having a pressure sensitive adhesive layer interposed between and securing such plies. An aperture is die cut, or otherwise formed, in the outer ply to expose a select area of the adhesive, and thereby present a recessed tack spot to which the leading end of the roll can be lightly adhered, and thus prevent it from withdrawing into the carton. However, Budny fails to disclose a passive retention feature, a feature which would retain the leading end of the roll without a conscious extra effort on the part of the user. The Budny carton requires the user to press a portion of the leading end of the roll against the recessed tack spot in order for the leading end to be prevented from withdrawing into the carton.

As yet other qualifications, a truly practical solution, or modification, to overcome the above problems, should be highly functional, its mode of operation readily perceived by the consumer with minimum required attention, and it should not, for any reason, add significantly to the overall cost of the carton, nor detract from its appearance or functionality in other regards.

Accordingly, it is the primary objective of this invention to provide an improved roll dispensing carton having a practical, effective and inexpensive feature for preventing return of the lead portion of the roll back into the carton.

It is another object of this invention to provide such a carton wherein the retaining feature is highly compatible with the manufacture, printing, erecting and loading of the carton, at commercially acceptable speeds.

A further objective of this invention is to provide such a dispensing carton wherein such retaining feature can be included in the carton design with minimum change required in existing production equipment, and with near 100% reliability.

A still further objective of this invention is to provide a means for protecting the feature for preventing return of the lead portion of the roll back into the carton after the carton is initially opened by the consumer and is thereafter closed without a portion of the lead portion of the roll being retained by the feature for preventing withdrawal of the lead portion of the roll into the carton.

Yet another objective of this invention is to provide a carton opening assisting means.

SUMMARY OF THE INVENTION

These and other objects are accomplished by providing an improved dispensing carton for materials supplied in roll form, the carton comprising a hollow, generally rectangular box, the box having a bottom panel, a first end panel, a second end panel, a front panel, said front panel having an upper edge, said upper edge being folded inwardly upon itself, a lower edge, said lower edge being remote from and generally parallel to the upper edge, an outer face and an inner face, a rear panel, a lid member, said lid member comprising a generally rectangular panel having four edges, a first edge hingedly connected to the adjacent edge of the rear panel, a second edge remote from and generally parallel to the first edge, a third edge generally normal to the first and second edges and a fourth edge generally normal to the first and second edges and generally parallel to the third edge, the second, third and fourth edges each having a flange which projects toward the bottom panel of the carton when the lid member is in a closed configuration, a frontal flange projecting from the second edge, a first end flange projecting from the third edge, a second end flange projecting from the fourth edge, the three flanges being adapted so that when the lid member is in the closed configuration, the frontal flange slideably overlaps a portion of the front panel of the carton for a vertical distance of greater than one-half the height of said front panel, said frontal flange having an inner face, an outer face, an upper edge foldably connected with the second edge of the lid member and a lower edge remote from the upper edge, the inner face of the frontal flange having affixed thereto a glue strip, the first and second end flanges slideably overlap portions of the first and second end panels respectively, wherein the improvement comprises:

(a) a cutting means having a cutting edge, the cutting means being in association with the lid member, said cutting means being positioned at, and generally parallel to the lower edge of the frontal flange of the lid member in such a manner that at least the cutting edge extends beyond the lower edge of the frontal flange of the lid member toward the bottom panel of the carton when the lid member is in the closed configuration;

(b) a material retaining means having an adhesive outer surface, said material retaining means being affixed to the outer face of the front panel of the carton and being positioned so that the frontal flange of the lid member covers the material retaining means when the lid member is in the closed configuration;

(c) an adhesive surface protecting means, said adhesive surface protecting means being affixed to the inner face of the frontal flange of the lid member and positioned so that said adhesive surface protecting means is generally opposite from and generally parallel to the material retaining means when the lid member is in the closed configuration; and, (d) a carton opening assisting means, said carton opening assisting means being an extension of at least a portion of the lower edge of the frontal flange of the lid member.

BRIEF DESCRIPTION OF THE DRAWINGS

Other objectives and advantages of the invention will be more apparent by reference to the following specification taken in view of the accompanying drawings wherein.

DETAILED DESCRIPTION OF THE PREFERRED EMBODIMENTS

Figure 1:
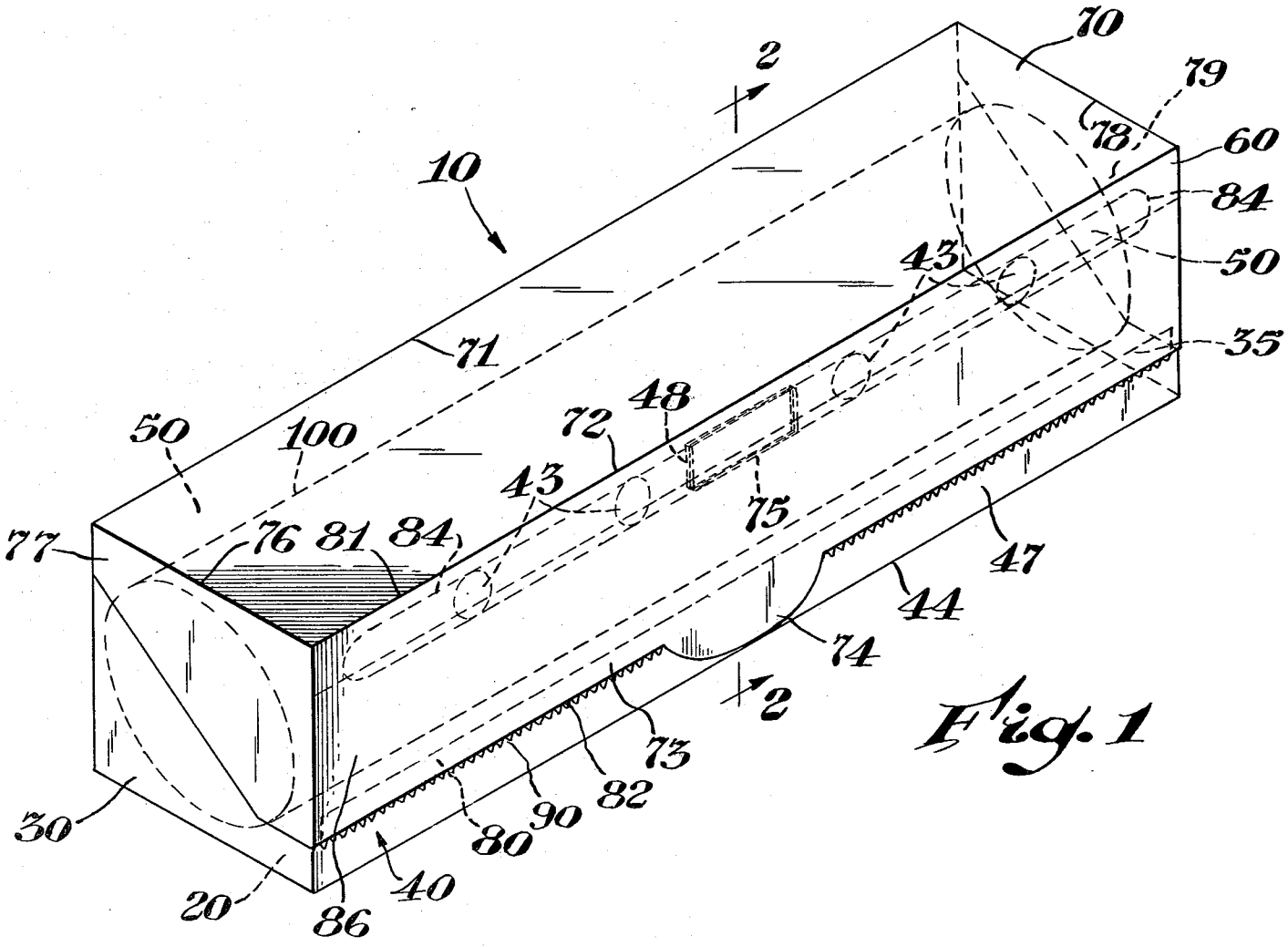
FIG. 1 is a front isometric view of a dispensing carton in accordance with the present invention showing the lid member in a closed configuration after the carton has been initially opened and a lead portion of the roll material has been placed against the cutting edge, torn and removed.

Referring now to FIG. 1, a dispensing carton for materials supplied in roll form in accordance with the present invention is generally designated by the reference numeral 10. The carton 10, shown in its erected form, comprises a plurality of panels foldably connected, including bottom panel 20, front panel 40, rear panel 25, first end panel 30, and second end panel 35. A lid member 60 is hingedly connected to an adjacent edge of the rear panel 25. Contained within the dispensing carton 10 is a roll 100 of material commonly supplied in roll form. The lid member 60 comprises a generally rectangular panel 70, the panel 70 having four edges, a first edge 71 hingedly connected to the adjacent edge of the rear panel 25, a second edge 72 remote from and generally parallel to the first edge 71, a third edge 76, the third edge 76 being generally normal to the first and second edges 71 and 72, respectively, and a fourth edge 78, the fourth edge 78 being generally normal to the first and second edges 71 and 72, respectively, and generally parallel to the third edge 76. The lid member 60 also includes three flanges, flange 73, flange 77 and flange 79 which project toward the bottom panel 20 of the carton 10 when the lid member 60 is in the closed configuration, the flanges 73, 77 and 79 projecting from edges 72, 76 and 79, respectively, of the generally rectangular panel 70. The flange 73 slideably overlaps a portion of the front panel 40 of the carton 10 for a distance of greater than one-half the height of the front panel 40 when the lid member 60 is in the closed configuration. The flange 73 has an upper edge 81 foldably connected with edge 72 of the rectangular panel 70, a lower edge 82 remote from the upper edge 81, an inner face 85 (see FIGS. 2 and 3) and an outer face 86. The flanges 77 and 79 are arranged so that when the lid member 60 is in the closed configuration, the flanges 77 and 79 slideably overlap portions of the first end 30 and the second end 35, respectively. The front panel 40 has an inner face 46 (see FIG. 2), an outer face 47, an upper edge 42 (see FIGS. 2 and 3), said upper edge 42 being folded inwardly upon itself thereby forming a strip 50 (see FIGS. 2 and 3), said strip 50 acting as a stiffener for a portion of the front panel 40 and providing a smooth edge over which to withdraw material from the roll 100, a lower edge 44, an embossed area 45 (see FIG. 3), said embossed area 45 being generally rectangular and being positioned generally centrally on the outer face 47 of the front panel 40 proximate to the upper edge 42 (see FIGS. 2 and 3) of the front panel 40 and a carton closure means such as a plurality of spaced glue dots 43, said plurality of glue dots being beneficially die cut and being arranged in such a manner that a line drawn through the center of each glue dot 43 is generally parallel to the upper edge 42 of the front panel 40. Those skilled in the art will recognize that the arrangement of the glue dots 43 is not critical, that the glue dots 43 are arranged along a generally straight line for ease of processing, and that the line of glue dots 43 may be in alignment with the embossed area 45, as shown in FIG. 1, out of alignment with the embossed area 45, or partially in alignment with the embossed area 45. Affixed to the inner face 85 (see FIG. 3) of the flange 73 is a glue strip 84, said glue strip 84 beneficially running the length of the outer face 47 of the front panel 40, the glue strip 84 being positioned so that when the lid member 60 is in the closed configuration, the glue strip 84 is generally adjacent to and opposite from the glue dots 43. The lid member 60 is free of the front panel 40 except for a portion of the outer face 47 along the line of glue dots 43, the lid member 60 being detachably attached to the outer face 47 of the front panel 40 by the glue strip 84 in cooperative combination with the glue dots 43 until after the carton has been initially opened. A material retaining means, or adhesive spot, 48 is affixed to the outer face 47 of the front panel 40 and is positioned so that the material retaining means 48 is generally adjacent to and generally parallel to the embossed area 45 and so that the flange 73 covers the material retaining means or adhesive spot 48 when the lid member 60 is in the closed configuration. An adhesive surface protecting means 75 is affixed to the inner face 85 (see FIGS. 2 and 3) of the flange 73 and positioned so that the adhesive surface protecting means 75 is generally opposite from and generally parallel to the material retaining means 48 when the lid member 60 is in the closed configuration. A cutting means, or cutter bar, 80 having a cutting edge 90 is affixed to the lid member 60 and is positioned along, and generally parallel to, the lower edge 82 of the flange 73 in such a manner that the cutting edge 90 extends beyond the lower edge 82 of the flange 73. A carton opening assisting means, or tab, 74 is integral with and is an extension of the lower edge 82 of the flange 73 proximate to the cutting means 80.

Figure 2:
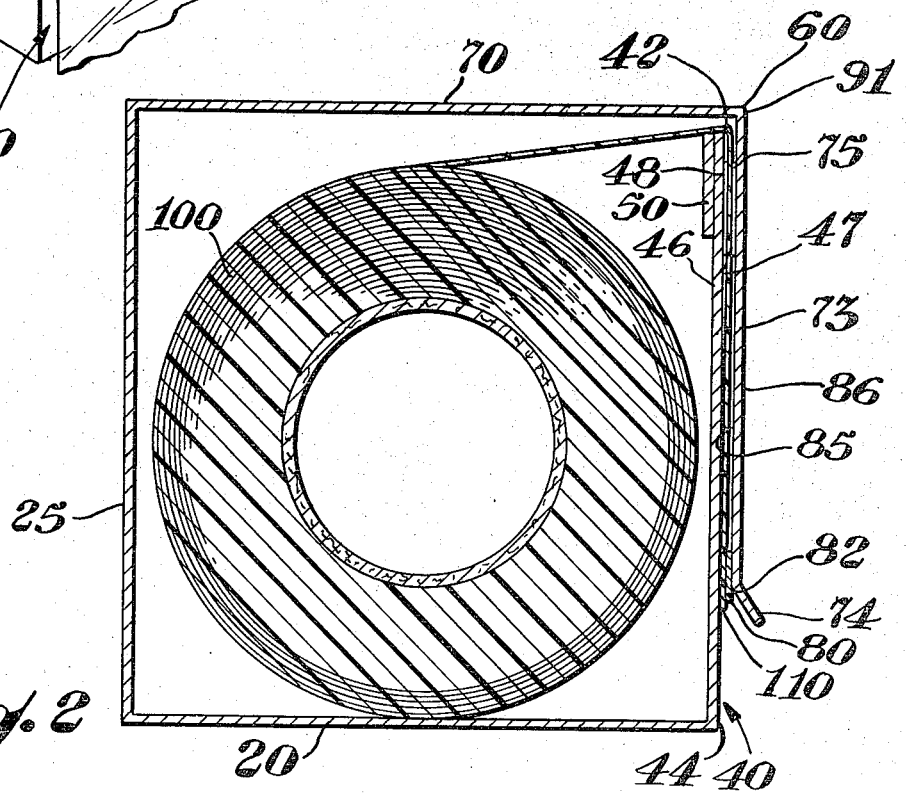
FIG. 2 is an enlarged transverse sectional view taken on line 2—2 of FIG. 1.

In FIG. 2, a transverse sectional view taken along line 2—2 of FIG. 1, the manner in which the materials supplied in roll form 100 is dispensed from the carton 10 is more clearly illustrated. A lead portion 110 of the roll 100 is drawn over the upper edge 42 of the front panel 40 between the material retaining means 48 and the adhesive surface protecting means 75 and along the outer face 47 of the front panel 40 toward and past the lower edge 44 of the front panel 40 until a desired length is obtained. The desired length is separated from the roll 100 by placing the lid member 60 in the closed configuration and pulling the lead portion 110 generally in a direction from the lower edge 44 to the upper edge 42 of the front panel 40 until the cutting means 80 causes the material to tear in a generally serrated line along the cutting edge 90 (see FIG. 1). After the desired length is separated, a new lead portion 110 is retained by the retaining means 48 and is held against the outward face 47 of the front panel 40 by the lid member 60 when the lid member is in the closed configuration as is illustrated in FIG. 2.

Figure 3:
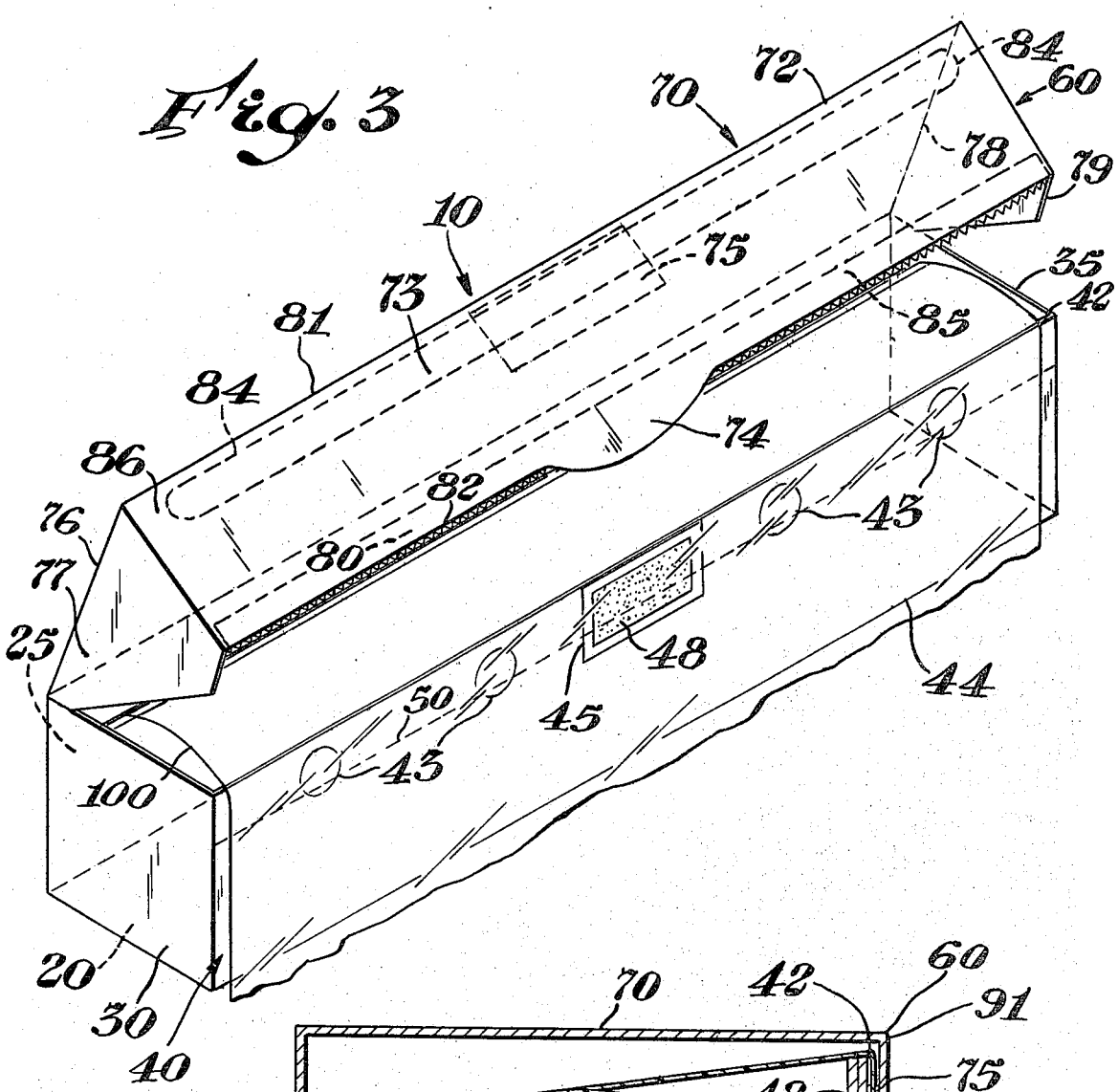
FIG. 3 is a front isometric view of the carton of FIG. 1 showing the carton lid in an open configuration with a lead portion of the roll material having been dispensed from the carton.

FIG. 3 shows the lid member 60 of the carton 10 in an open configuration with the lead portion 110 of the material on the roll 100 being withdrawn prior to tearing off. When a person has extended the desired length of material, he or she returns the lid member 60 to the closed configuration and places his or her thumb over a central portion of the outward face 86 of the flange 73 and by pulling upward or generally in the direction going from the lower edge 82 of the flange 73 toward the upper edge 81 of the flange 73, forces the material being withdrawn from the roll 100 against the cutting edge 90 of the cutting means 80 and causes the material to be torn in a generally serrated line along the cutting edge 90.

It is significant to note at this point, proportions shown in FIGS. 1 thru 3 are merely for purposes of illustration and are not to scale. In particular, the thicknesses shown in FIG. 2 are greatly exaggerated for clarity of illustration. Hence, the addition, to the outer face 47 of the front panel 40, of the material retaining means 48, the embossed area 45, and the attachment of the adhesive surface protecting means 75 and the addition of the cutting means 80 to the inner face 85 of the flange 73 do not in any way interfere with dispensing of material contained on the roll 100 from the carton 10 or the tearing off of a desired length of the material contained on the roll 100 by tearing the material in a generally serrated line along the cutting edge 90.

When it is desired to withdraw a portion of the material from the roll 100, it is necessary merely for a person to grasp the carton opening assisting means, or tab 74 and pull said tab 74 generally outward and upward. The person will then grasp the lead portion 110 of the material contained on the roll 100 and withdraw a desired length from the carton 10 by drawing the material over the upper edge 42 of the front panel 40 and down the front panel 40 generally from the upper edge 42 of the front panel 40 toward the lower edge 44 of the front panel 40 until the desired length is obtained. The lid member 60 is then placed in the closed configuration and the material is placed against the cutting edge 90 and torn in the manner commonly used in dispensing cartons of this type. When the material is placed against and torn along the cutting edge 90 to effect cutting the material, a new lead portion 110 of the material if formed, said new lead portion 110 covers the front panel 40 of the carton 10 for generally the same distance as the flange 73, said new lead portion 110 being brought in contact with the outer face 47 of the front panel 40 and with the material retaining means 48 during the tearing off of the desired length of material. The material retaining means 48 contains an adhesive which will releasably hold the material on the roll without causing same to be torn when the material is pulled away from the material retaining means 48 as the person desires another portion of the roll. This adhesion prevents additional material from being accidentally unrolled during the cutting operation and holds the edge of the sheet securely thereby facilitating tearing. In addition, after the cutting operation, a portion of the lead portion 110 is held against the adhesive spot 48 and is restrained from retracting into the carton 10. Also, by virtue of the lid member 60 being in its closed configuration, the material is restrained from folding upon itself, wrinkling or sustaining other damage.

This procedure can be used repeatedly until the supply of material contained on the roll 100 is exhausted. The adhesive spot 48 must have sufficient "tack" to releasably hold the material being dispensed from the carton without having so much tack that it is difficult to pull the material away from the adhesive spot 48 or such that it will cause tearing of the material being dispensed. This can easily be accomplished by attaching any of the well known adhesives to the front panel 40 of the carton either in the form of a pressure sensitive adhesive tape having an adhesive on both major surfaces or as an adhesive forming liquid which exhibits tack when dry. However, the preferred adhesive material is a label, said label having two sides, an inward side having high tack and being affixed to the front panel 40 of the carton 10, and an outward side having low tack, said outward side being covered by a release paper (not shown). During carton assembly the label or adhesive spot 48 is placed as shown in FIGS. 1 and 3 and a glue spot (not shown) is applied to the inner face 85 of the flange 73 and positioned so that the release paper (not shown) of the label is adhered to the inner face 85 of the flange 73 by the glue spot (not shown). The release paper (not shown) thus becomes the adhesive surface protecting means 75. Other means will suffice as an adhesive surface protecting means, one of such means being coating the inner surface 85, of the flange 73, with a clear lacquer, varnish or other adhesive resistant material.

While container 10 and its various aforesaid components are manufactured in a well known manner, and somewhat similar to that disclosed in Buttery et al., U.S. Pat. No. Re. 25,876, the teachings of which are incorporated herein by reference thereto, it is well to note the following brief summary of such manufacture. A blank of laminated paperboard, or the like, of sufficient thickness is usually sequentially printed on its outer side, as with advertising, etc., die cut, scored, creased and embossed to form the front panel 40, the bottom panel 20, the rear panel 50, the first end panel 30, the second end panel 35, the rectangular panel 70, the frontal flange 73, the first end flange 77 and the second end flange 79, stripped of excess material and provided with a cutting means to which is suitably attached thereto. The printing and die cutting operations produce unprinted die cut areas. Next the container blank is placed in a "gluing" machine which applies a strip of liquid resinous glue 84 on the inner face 85 of the flange 73 along its length and, when the glue dots 43 are out of alignment with the adhesive spot 48, a glue spot (not shown) on the inner face 85 of the flange 73, said glue spot (not shown) being positioned so that it is generally parallel to and generally opposite from the adhesive spot 48, and folds container 10 flat, in any suitable manner. The printed intermediate areas which are coated during printing by a clear lacquer, varnish, high gloss inks incorporating lacquer, varnish or the like are adhesive resistant and are not glued. Thus, upon leaving the gluing machine the so folded and glued container is ready for unfolding, inserting of the material supply roll, by end loading, and folding and gluing of the various flaps (not shown) and flanges thereby forming the end panels 30 and 35 and the flanges 73, 77 and 79.

The cutter bar 80 may be either plastic or metal. The many advantages of the invention include its near perfect compatibility with equipment for producing cartons of the type contemplated. For example, the fabrication steps called for by this invention contemplate folding, scoring, and adhesive applying steps that are generally in like character to steps performed on existing carton fabricating equipment, at high production speeds.

Moreover, it can be appreciated that the material costs of this particular combination of carton features do not add unreasonably to the cost of providing the carton.

Understandably, the term "pressure sensitive adhesive" is employed herein in a broad sense to include any composition or material having adequate affinity for the rolled material contained within the carton to operate as a retention feature in the manner contemplated above. As an illustrative example only, a preferred adhesive composition having affinity for SARAN Brand household wrapping materials comprises a double sided differential tack label stock commercially available from Flexcon Company, Inc. under the trade designation DFP-100-CV 303-2V23. A second preferred adhesive composition is double coated film tape having a high tack adhesive on one side and a low tack adhesive on the opposite side, the film tape being commercially available from the 3M Company under the trade designation Y-9415. In all cases, the high tack side of the adhesive composition is affixed to the front panel 40 of the carton 10 and the low tack side of the adhesive composition is exposed to the leading edge 110 of the material contained on the roll 100.

While the preferred embodiments of the invention have been shown with regard to specific details in carton designs, it will be appreciated that depending upon the carton design and the manufacturers' desires, the invention may be modified by various changes while still being fairly within the scope of the general teachings and principles hereof.

What is claimed is:

1. An improved dispensing carton for materials supplied in roll form, the carton comprising a hollow, generally rectangular box, the box having a bottom panel, a first end panel, a second end panel, a front panel, said front panel having an upper edge, said upper edge being folded inwardly upon itself, a lower edge, said lower edge being remote from and generally parallel to the upper edge, an outer face and an inner face, a rear panel, a lid member, said lid member comprising a generally rectangular panel having four edges, a first edge hingedly connected to the adjacent edge of the rear panel, a second edge remote from and generally parallel to the first edge, a third edge generally normal to the first and second edges and a fourth edge generally normal to the first and second edges and generally parallel to the third edge, the second, third and fourth edges each having a flange which projects toward the bottom panel of the carton when the lid member is in a closed configuration, a frontal flange projecting from the second edge, a first end flange projecting from the third edge, a second end flange projecting from the fourth edge, the three flanges being adapted so that when the lid member is in the closed configuration, the frontal flange slideably overlaps a portion of the front panel of the carton for a vertical distance of greater than one-half the height of said front panel, said frontal flange having an inner face, an outer face, an upper edge foldably connected with the second edge of the lid member and a lower edge remote from the upper edge, the inner face of the frontal flange having affixed thereto a glue strip, the first and second end flanges slideably overlap portions of the first and second end panels repectively, wherein the improvement comprises:

a cutting means having a cutting edge, the cutting means being in association with the lid member, said cutting means being positioned at, and generally parallel to the lower edge of the frontal flange of the lid member in such a manner that at least the cutting edge extends beyond the lower edge of the frontal flange of the lid member toward the bottom panel of the carton when the lid member is in the closed configuration;

a material retaining means having an adhesive outer surface, said material retaining means being affixed to the outer face of the front panel of the carton and being positioned so that the frontal flange of the lid member covers the material retaining means when the lid member is in the closed configuation;

an adhesive surface protecting means, said adhesive surface protecting means being affixed to the inner face of the frontal flange of the lid member and positioned so that said adhesive surface protecting means is generally opposite from and generally parallel to the material retaining means when the lid member is in the closed configuration;

and a carton opening assisting means, said carton opening assisting means being an extension of at least a portion of the lower edge of the frontal flange of the lid member.

2. The dispensing carton of claim 1 wherein the material supplied in roll form is a polymeric film, wax paper or a metal foil.

3. The dispensing carton of claim 2 wherein the cutting means is a cutting bar.

4. The dispensing carton of claim 3 wherein the cutting bar is either plastic or metal.

5. The dispensing carton according to claim 4 wherein the material retaining means having an adhesive outer surface comprises a pressure sensitive double sided adhesive material.

6. The dispensing carton of claim 5 wherein the carton opening assisting means is a centrally located tab.

* * * * *